US006547077B1

(12) United States Patent
Budert

(10) Patent No.: US 6,547,077 B1
(45) Date of Patent: Apr. 15, 2003

(54) TOOL HOLDER

(75) Inventor: Guenter H. Budert, Bachhagel (DE)

(73) Assignee: Georg Knoblauch GmbH, Giengen (DE)

( * ) Notice: Subject to any disclaimer, the term of this patent is extended or adjusted under 35 U.S.C. 154(b) by 0 days.

(21) Appl. No.: 09/626,641

(22) Filed: Jul. 27, 2000

(30) Foreign Application Priority Data

Jul. 28, 1999 (DE) ..... 299 13 188 U

(51) Int. Cl.[7] ..... B65D 79/00
(52) U.S. Cl. ..... 206/754; 206/379
(58) Field of Search ..... 206/379, 378, 206/457, 754, 755; 220/817, 818, 819; 211/70.6

(56) References Cited

U.S. PATENT DOCUMENTS 4,660,719 A * 4/1987 Peterson et al. ..... 206/379
4,934,530 A * 6/1990 Riess ..... 206/379
4,955,476 A * 9/1990 Rau et al. ..... 206/379
5,148,914 A * 9/1992 Budert et al. ..... 206/1.5
5,746,316 A * 5/1998 La Barre ..... 206/379
5,775,499 A * 7/1998 Budert ..... 206/379
5,829,590 A * 11/1998 Klein ..... 206/369

* cited by examiner

*Primary Examiner*—Mickey Yu
*Assistant Examiner*—Troy Arnold
(74) *Attorney, Agent, or Firm*—M. K. Silverman

(57) ABSTRACT

A tool holder for elongate tools, in particular drill bits, having a front wall part, having a receiving device for the tools and having a rear wall part, the two wall parts being movable relative to one another in order to release a filling and removal opening, wherein the two wall parts are arranged and/or designed in such a manner that, in the closed state of the tool holder, there is a distance (A) between the two wall parts.

19 Claims, 4 Drawing Sheets

TOOL HOLDER

The invention relates to a tool holder for elongate tools, in particular drill bits, of the type which is defined in more detail in the preamble of claim 1.

Tool holders which comprise a large number of different individual parts and are of relatively complicated structure are known in practice. The large number of different individual components requires a large number of different production tools and a relatively high number of assembly steps. Furthermore, the large number of different components entails not inconsiderable stock-keeping costs.

In view of the above facts, the known tool holders are generally relatively expensive to produce and manufacture.

Furthermore, there is scarcely any difference between the external appearance of the known tool holders, and consequently it is generally impossible for the customer or user to associate a tool holder with a specific manufacturer using its external design. Moreover, the appearance of the known tool holders is visually relatively unappealing.

Therefore, the object of the present invention is to provide a tool holder for elongate tools, in particular drill bits, which can be produced quickly, easily and inexpensively and which combines a functional structure with a design which is at the same time visually appealing to the user.

According to the invention, this object is achieved by means of the features which are listed in the defining part of claim 1.

The distance between the front component and the rear component which is produced in the closed state of the tool holder results in the possibility of bridging this distance with other components, in particular the receiving device, which may have virtually any desired appearance.

The possibility of bridging the abovementioned distance with components of virtually any desired shape makes it possible to provide the tool holder with an appearance which is generally attractive and/or typical of a specific manufacturer of tools or tool holders. It is therefore possible for the user or potential purchaser to associate a specific external appearance with the manufacturer of tools and/or tool holders, resulting in not inconsiderable room to differentiate from tool holders from other manufacturers, which is highly advantageous from an advertising viewpoint.

Furthermore it is possible, due to the distance which is produced even in the closed state, to remove the tools from the tool holder much more easily in the open state, since in the open state of the tool holder the distance increases by the level of the distance which exists in the closed state. This also contributes, inter alia, to enabling the receiving device or tool holder to be filled better and therefore more quickly and at lower cost.

One possibility of changing the distance between the front wall part and the rear wall part using design measures is achieved by the fact that the front wall part is connected to the receiving device in such a manner that it can pivot about an axis, and furthermore by the fact that the rear wall part is connected to the receiving device in such a manner that it can pivot about an axis, the two axes preferably lying at a distance from one another, in such a manner that one axis is situated closer to the rear wall part and the other axis is situated closer to the front wall part.

The fact that, in the region of the receiving device, the two wall parts are arranged so that they can rotate about in each case one axis makes it possible to influence or change the distance between the two wall parts which is produced in the closed state of the tool holder, resulting in a greater level of freedom for the visual and functional design of the tool holder.

An embodiment which is highly advantageous in particular with regard to the ease and speed of assembly consists in the fact that the receiving device, in the region of the axis at which the receiving device is pivotably connected to the rear wall part, in each case has a pin on both sides, and furthermore in the region of the axis at which the receiving device is pivotably connected to the front wall part, has further pins, likewise on both sides, which together with holes in the two wall parts form axes.

This design makes it possible to reduce the number of individual parts in the tool holder, since it is possible to dispense with additional separate parts such as bolts, rivets or screws.

This accelerates and simplifies the assembly time and assembly work considerably and therefore contributes to a reduction in the production costs.

Furthermore, the reduction in the number of separate individual parts also minimizes the storage and logistics costs. Finally, the complete assembly operation is significantly facilitated thereby.

A further, particularly advantageous embodiment in terms of the assembly and the subsequent ease of handling during use of the tool holder according to the invention consists in the fact that the receiving device has at least one pin at its region which is remote from the pivot axis, and furthermore that the rear wall part has at least one slot arranged in a side wall of the rear wall part, and in that a distance between the axis of the receiving device and the pins arranged at the region remote from the axis approximately corresponds to the distance between the axis and the slot arranged on the rear wall part. Furthermore, the advantageous embodiment is achieved by the fact that the pin is guided movably in the slot and by the fact that a pivot angle between the rear wall part and the receiving device can be limited by the pin which is guided in the slot.

This design also results in a reduction in the number of components, and this in turn increases the speed of assembly and minimizes the assembly work or the number of assembly steps. Consequently, with this design it is possible to dispense with the standard small parts, such as hooks and wires, which are used in known tool holders normally to limit the pivot angle in these known tool holders.

Particularly secure fixing of the elongate tools situated in the receiving device, in particular the drill bits, is achieved by the fact that a tool-securing device is arranged on the front wall part.

The tool-securing device fixes the drill bits inside the tool holder in their axial position, so that the drill bits cannot slip out of the receiving device during transport.

The tool holder is made particularly easy to open and close if the front wall part and the rear wall part have angled-off tabs, the base surfaces of which face toward the respectively other wall part. The arrangement of the tabs makes the tool holder particularly simple and comfortable for the user to employ, in that he can quickly and easily fold it open or shut.

Undesirable opening or folding open of the tool holder according to the invention can be prevented particularly easily and with relatively little effort by the fact that the angled-off tab parts, in the closed state of the tool holder, form a partial groove or a distance between them, in which case a hanging element which can pivot, for example, about an axis running at least approximately in the folding-open direction, and rests in the partial groove or bridges the distance, may be arranged on the tool-securing device. At its end region which is remote from the axis and faces toward the tool-securing device, the hanging element may have at least one latching element, in which case the latching element can be latched in in the region of the tabs and/or the tool-securing device; the hanging element can be folded in, in particular, between the partial groove formed by the two angled-off tabs, so that the front wall part is locked to the rear wall part so that it cannot be opened unintentionally.

In a refinement of the invention, simple assembly of the tool-securing device and reliable attachment of the tool-securing device to the front wall part is achieved by the fact that the tool-securing device has pins and the fact that the front wall part has holes into which the pins latch.

This further reduces the number of individual parts and facilitates assembly.

Advantageous embodiments and refinements of the invention will emerge from the subclaims and from the exemplary embodiment which is outlined below with reference to the drawing, in which:

Figure 1:
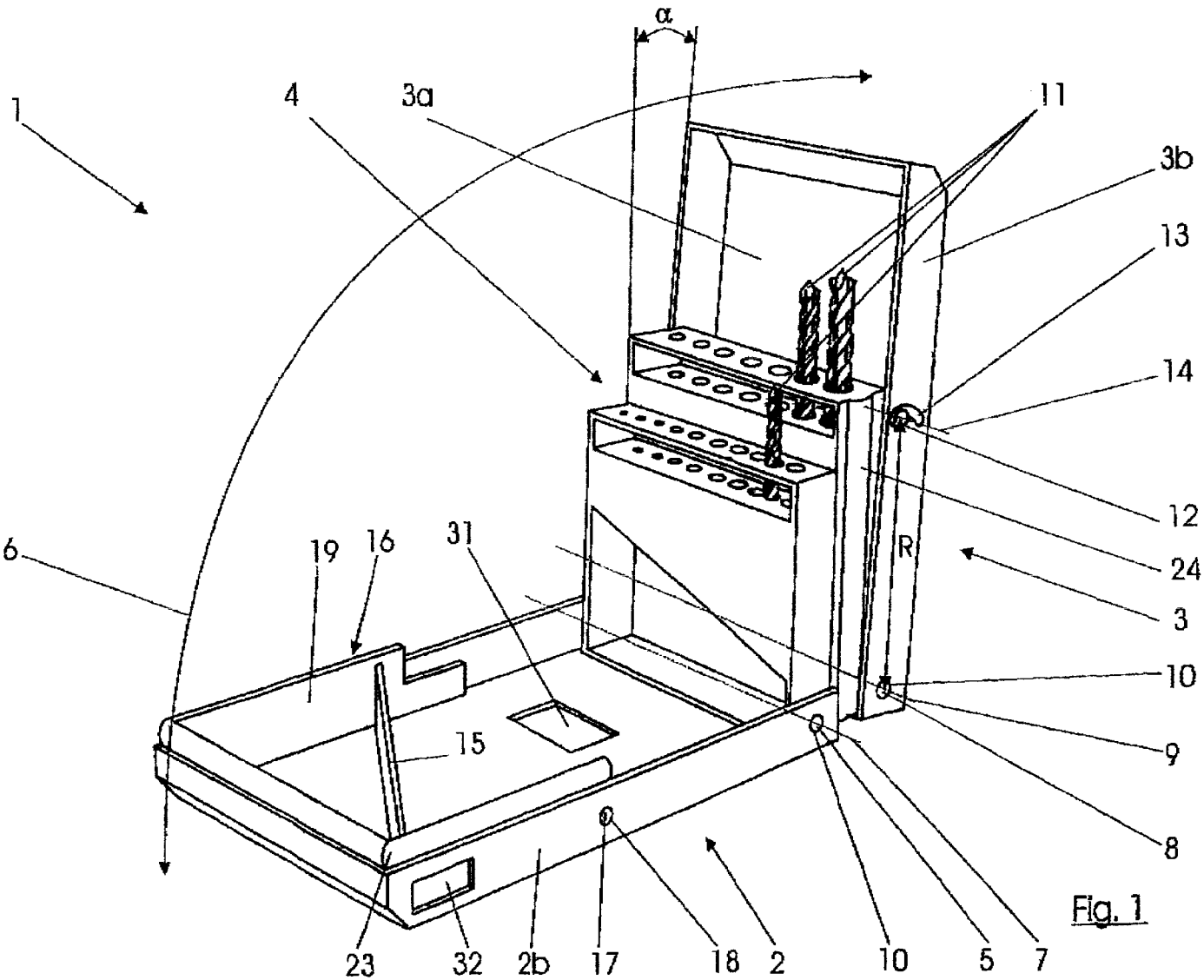
FIG. 1 shows a tool holder according to the invention in the folded-open state (without tabs)

FIG. 1 shows a perspective illustration of the tool holder 1 in the folded-open state, resulting in a filling and removal opening being formed from the top region. The tool holder 1 has a front wall part 2 and a rear wall part 3. The front wall part 2 and the rear wall part 3 each have a back wall 2*a*, 3*a* and in each case two side walls 2*b*, 3*b* which are arranged at right angles to the back walls 2*a*, 3*a*.

The front wall part 2 is connected to the receiving device 4 in such a manner that it can pivot about an axis 7 arranged close to the base, transversely with respect to the folding-open direction (arrow 6), via pins 5 arranged on both sides of a receiving device 4 (only one pin can be seen in the drawing). The rear wall part 3 is likewise connected to the receiving device 4 in such a manner that it can pivot about an axis 9 arranged close to the base and facing more closely toward the rear wall part 3, via further pins 8 arranged on the receiving device 4.

The front wall part 2 and the rear wall part 3 are preferably made from metal, and the receiving device 4 is preferably made from plastic. The receiving device 4 is usually produced using the injection-molding process, so that the pins 5, 8 can in practice be injection-molded on at the same time as the receiving device 4 is being produced.

The front wall part 2 and the rear wall part 3 have holes 10 through which the pins 5 of the receiving device 4 project. The pins 5 have an axial length which is fixed in such a manner that the wall parts 2, 3 can be connected to the pins 5 by hand without additional tools and the pins 5 latch into the holes 10 in the wall parts 2, 3. Naturally, the wall parts 2, 3 can be detached again easily, since this is a releasable type of connection. This also enables the tool holder 1 to be displayed at the point of sale, for example with the front wall part 2 lifted off, so that the user or the potential purchaser can look at the drill bits 11 arranged in the receiving device 4. When the tool holder 1 is purchased, the customer can then simply secure or attach the front wall part 2 to the receiving device 4 himself without having to use any additional tool.

Furthermore, the receiving device 4 has lateral pins 12. These pins 12 are guided movably in slots 13 which are likewise arranged on both sides of the rear wall part 3 in the side walls 3*b* thereof (only one slot is visible). The slots 13 are in this case in the shape of an arc, the radius of curvature R corresponding to the distance between the center axis 14 of the pins 12 which are guided in the slots 13 and the pin 8 on which the rear wall part 3 is pivotably mounted.

The length of the slots 13 can therefore be used to fix the maximum pivot angle $\alpha$ through which the receiving device 4 can pivot away from the rear wall part 3. The pivoting movement of the receiving device 4 with respect to the rear wall element 3 allows the drill bits 11 to be removed from the receiving device 4 more easily, since the rear wall part 3, which makes it difficult to remove the drill bits 11, can be pivoted away.

At the end region which is remote from the base or the standing surface of the tool holder 1, a U-shaped tool-securing device 16, which has an inclined web 15 and is arranged between the sides walls 2*b*, is attached to the front wall part 2. The inclined web 15 is in this case arranged in such a manner that, in the closed state of the tool holder 1, the web 15 limits the freedom of movement of the drill bits 11 of different length, which are arranged in the receiving device 4, in the axial direction of the drill bits, in such a manner that when the tool holder 1 is being transported the drill bits 11 cannot slip out of the receiving device 4 and then lie around freely inside the tool holder 1.

Moreover, the tool-securing device 16 has a plurality of pins 17 (only one pin is visible), which can latch into corresponding holes 18 arranged on the front wall part 2. In this way, the tool-securing device 16 can be assembled with the front wall part 2 without using a special tool and with relatively little effort. In this case, the U-shaped part 19 (see FIG. 1) of the tool-securing device 16 is attached to the front wall part 2 in such a way that the open side of the U shape, in the closed state of the tool holder 1, faces the base or the standing surface.

Figure 2:
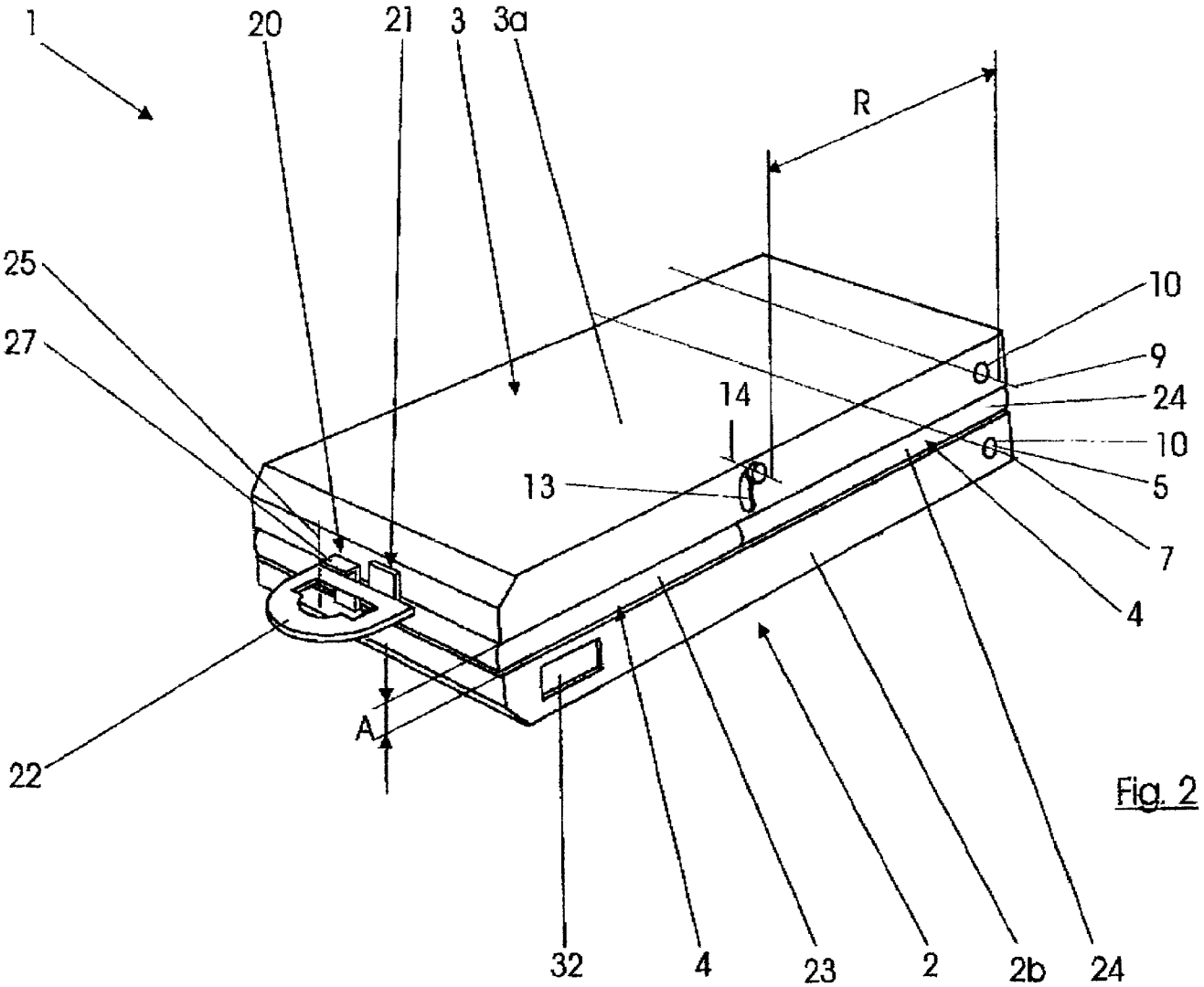
FIG. 2 shows the tool holder in the folded-together state.

FIG. 2 shows a perspective illustration of the tool holder 1, in the closed state. This figure very clearly shows a distance A which results from the different position of the axes 7 and 9 about which the front wall part 2 and the rear wall part 3 can pivot. Of course, this distance A may also be brought about using different measures. For example, the side parts 2*b*, 3*b* of the front and rear wall parts 2, 3 can also be shortened in such a manner that a distance A is formed between the two wall parts 2, 3. In principle, a distance A between the two wall parts 2, 3 can also be brought about using only a single pivot axis. However, the two axes 7, 9 at different positions result in a relatively long service life of the tool holder 1.

Furthermore, angled-off and off settable tab parts 20, 21 which are respectively arranged on the front wall part 2 and on the rear wall part 3 are illustrated in FIG. 2. In addition, a hanging element 22 arranged on the U-shaped part 19 of the tool securing device 16 can be seen.

To ensure that the drill bits 11 arranged in the receiving device 4 of the tool holder 1 are nevertheless well protected from external influences, the distance A which results in the closed state of the tool holder 1 is closed off in the region close to the base, extending to approximately halfway along the tool holder 1, by means of the receiving device 4, and in the remaining region by the U-shaped part 19 (see FIG. 1) of the tool-securing device 16.

This is possible because the receiving device 4 arranged in the rear wall part 3 extends suitably far in the direction of the front wall part 2 in the closed state, and the U-shaped part 19 of the tool-securing device 16 which is arranged in the front wall part 2 extends in the direction of the rear wall part 3 in the closed state.

Consequently, even those parts which are not visible in the tool holders which are known in practice, such as the receiving device and the tool-securing device, are visible.

The fact that these components are visible on the outside results in a large number of new design and creative options. For example, it is possible to produce a two-colored tool holder 1 simply by producing the receiving device 4 and/or the tool-securing device 16 from materials of different colors, without any complex sticking operation being required before any painting step.

Furthermore, the shape of those regions of the tool-securing device 16 and the receiving device 4 which are visible on the outside can be changed virtually as desired, so that it is possible to generate an appearance which is extremely individual and particularly attractive to the customer or user. By way of example, rigid strips 23, 24 which extend laterally outward may be formed on the tool-securing device 16 and on the receiving device 4. See FIG. 2. Said strips at the same time, at the edges, serve as a stop for the two wall parts 2, 3.

Moreover, it is also possible to eliminate different individual components. Consequently, the hanging element 22 is formed integrally with the tool-securing device 16. A considerable advantage of this arrangement is that the hanging element 22 and the tool-securing device 16 are made from plastic, and consequently the two parts can be produced simultaneously using the same injection mold, so that the overall production costs are minimized.

Figure 3:
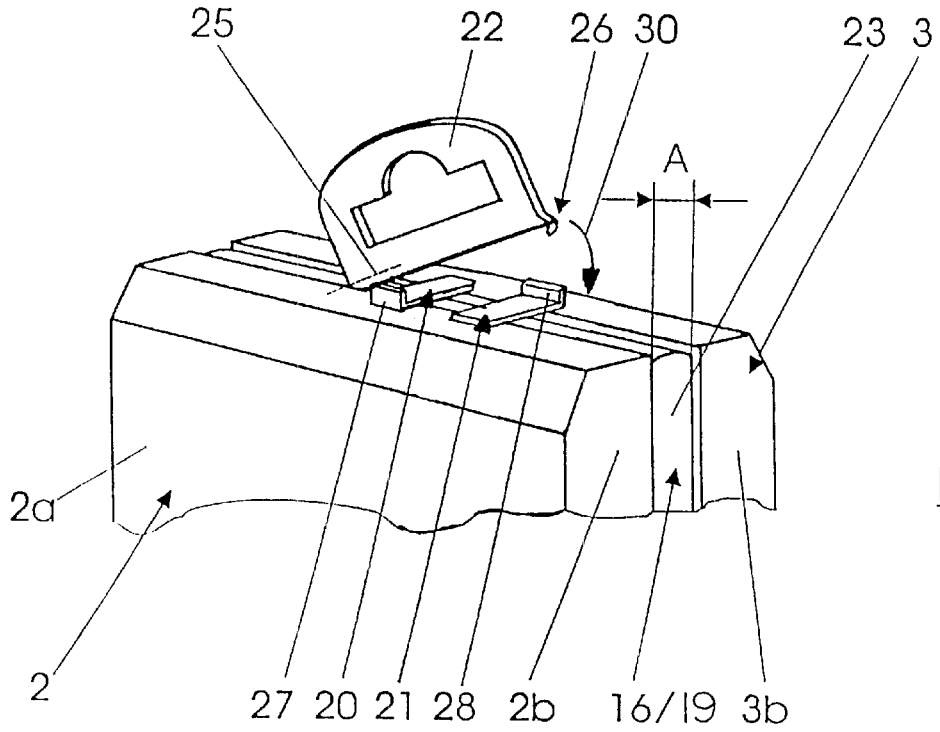
FIG. 3 shows an enlarged illustration of the tool holder with tabs and a hanging element arranged thereon, in the unlocked stage.
Figure 4:
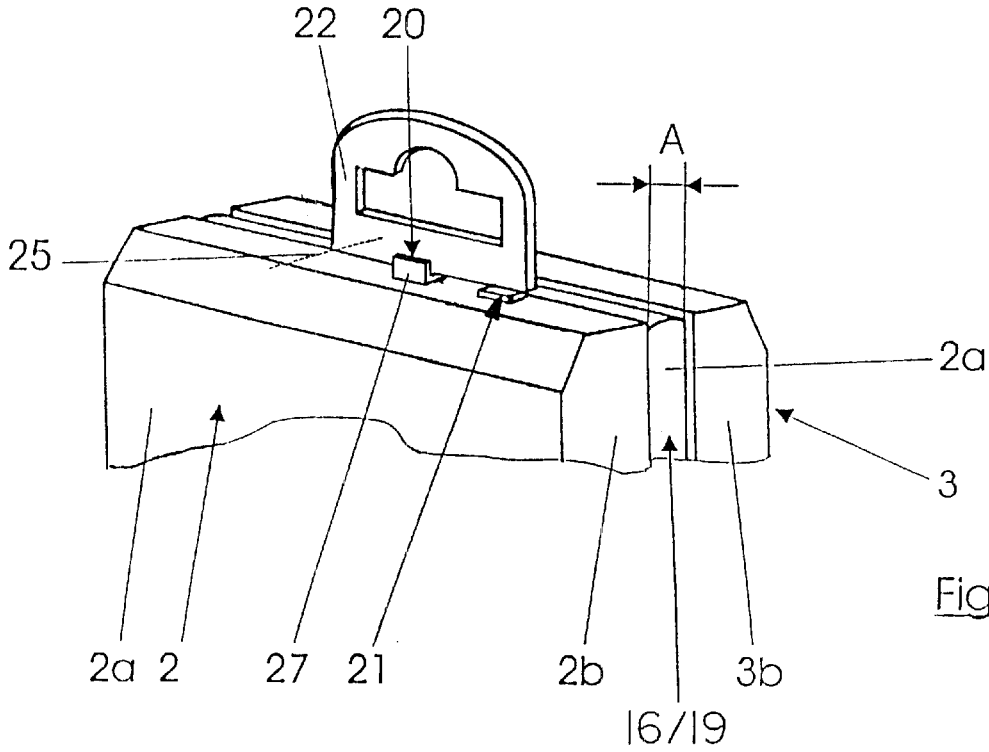
FIG. 4 shows an enlarged illustration of the tool holder with the tabs arranged thereon, in the locked state.

FIG. 3 also shows an enlarged perspective illustration of that end region of the tool holder 1 which is remote from the base in the closed state. This figure illustrates the hanging element 22, which is connected to the U-shaped part 19 (see FIG. 1) of the tool-securing device 16 via a type of solid joint. In this case, the hanging element 22 can pivot, as by axle or pin means (not shown), about an axis 25 (see FIGS. 2–5) which points at least approximately in the folding-open direction (arrow 6) of the tool holder 1. See FIG. 1. In this arrangement, the hanging element 22 has, at its end region which faces toward the axis 25 about which it can pivot and toward the tool-securing device 16, a latching element 26, by means of which the hanging element 22—as shown in FIG. 4—can be latched in, at or beneath one of the two angled-off tabs 20, 21, as shown in FIG. 4. In addition to its hanging function, the hanging element 22 is also responsible for a locking function on the tool holder 1, i.e. the two wall parts 2, 3 can be locked together using this hanging element 22, so that the tool holder 1 is closed securely.

Figure 5:
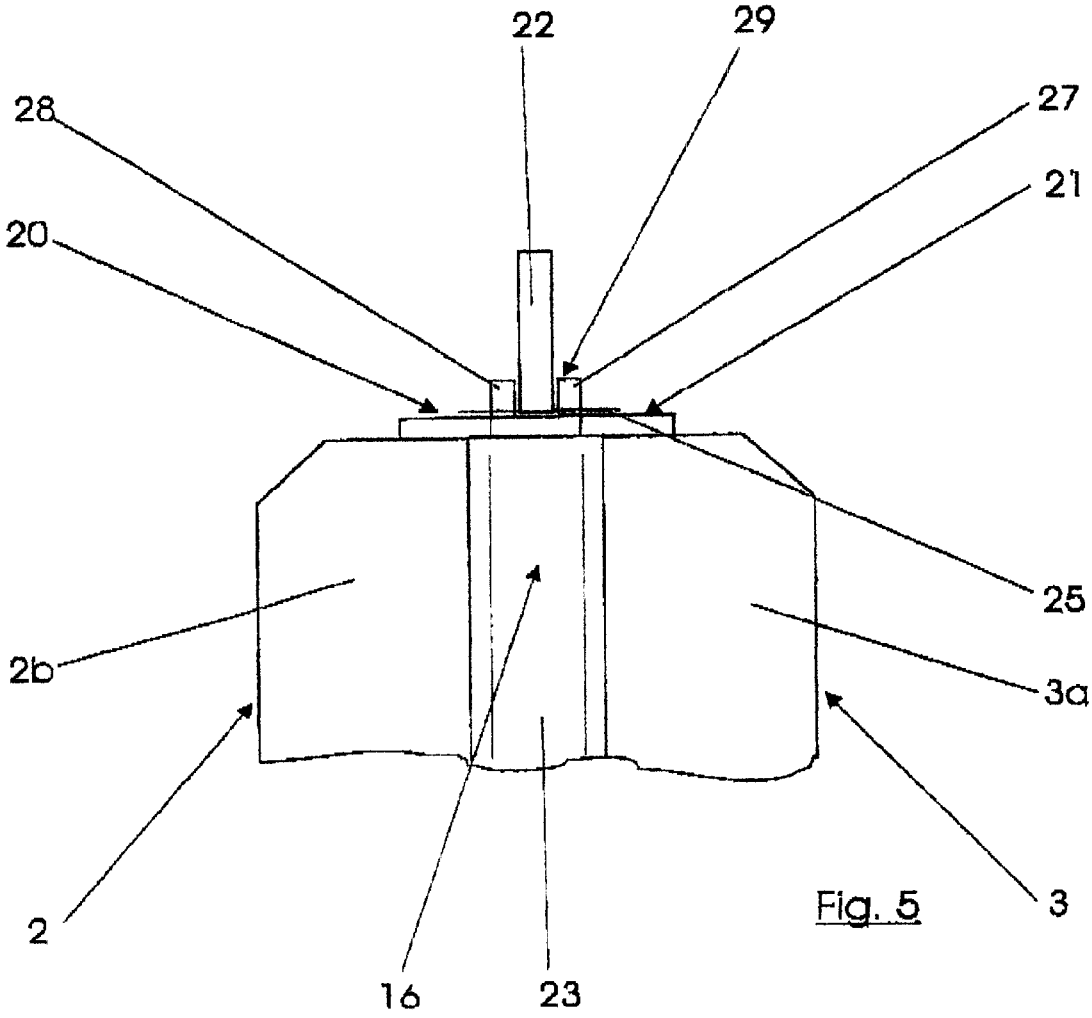
FIG. 5 shows a side view of the illustration shown in FIG. 4.

FIG. 5 shows a side view of the region of the tool holder 1 which is shown in FIG. 4. The tabs 20, 21 arranged on the front wall part 2 and on the rear wall part 3 each have a region 27, 28 which runs at least approximately parallel to the hanging element 22. Those regions 27, 28 of the offset tabs 20, 21 which can move at least approximately parallel to the hanging element 22 are in each case arranged closer to the other wall part. The two regions 27, 28 of the tabs 20, 21 which run parallel to the hanging element 22 therefore practically intersect one another or are guided past one another and in this way form a type of virtual groove 29 or space. See FIG. 5. The hanging element 22 can be folded into this groove 29, as indicated by an arrow 30 in FIG. 3. The hanging element 22 and the two regions 27, 28 of the tabs 20, 21 which move parallel to the hanging element 22 thus, by being secured to the respectively other wall part 2 or 3, effect a pressure-fit connection. This pressure-fit prevents the front and rear wall parts 2, 3 from being folded apart when locked to one another thus preventing undesirable opening of the tool holder 1. Finally, a particularly secure locking is ensured by the fact that the (lacuna) on the hanging element 22, which forms the pressure fit between the tab regions 27, 28 running parallel thereto, includes the latching element 26 which then latches in beneath one of tabs 20, 21 and holds the hanging element 22 securely when in its locked position.

In addition, it should also be mentioned that, by way of example, the front and rear wall parts 2, 3 may be identical, so that the number of different types of parts is reduced further. This has the advantage, for example, that the front wall part 2 and the rear wall part 3 can be produced using the same mold. Consequently, by way of example, the tool-securing device 16 can also cover the slot which, if the front and rear wall parts 2, 3 are absolutely identical, is also present in the front wall part 3. Therefore, the overall result in only three different components which have to be connected to one another, leading overall to a considerably reduced variety of parts, significantly reducing the assembly outlay and substantially shortening the assembly time.

As can be seen from FIG. 1, the front wall part 2 may also be provided with a window 31. The receiving device 4 can be seen through the window 31 in the closed state. The window 31 also produces a visually attractive and individual design in the region of the front wall part 2 if a receiving device 4 is of a different color from the two wall parts 2 and 3. Furthermore, this area can also be used for company logos or other information.

Of course, to provide further variety, other cutouts, as indicated by "32" in the side wall 2*b* of the front wall part 2, may also be present in the front wall part 2 and the rear wall part 3. In principle, there are no limits on the individual design of the tool holder in terms of its shape and color.

Furthermore, the tool holder 1 leaves a large number of aesthetic and design options which can be used to produce an appearance which is attractive and individual to a manufacturer. The embodiments mentioned here are purley by way of example. They may of course also be designed differently.

What is claimed is:

1. A tool holder for elongate tools, including drill bits, the tool holder comprising:

(a) a front wall part having receiving means for said elongate tools, said front wall part having a first edge thereof;

(a) a rear wall part having a first edge thereof having substantially like length to said first edge of said front wall part;

(c) pivot means for connecting said respective first edges of said front and rear wall parts to facilitate angular movement between said parts; and (d) means for defining a recessed offset at a particular distance (A) between said front and rear wall parts, when said parts are closed, between at least free edges of said wall parts, exclusive of said first edges thereof, said offset means integral to said free edges of at least one of said wall parts, said offset means comprising a peripheral lip having a transverse width which defines said distance (A).

2. The tool holder as recited in claim 1, in which said receiving means, in proximity to said pivot means, comprises pins at each end of an axis thereof.

3. The tool holder as recited in claim 1, in which said receiving means comprises:

means for limiting an extent of angular displacement of said pivot means with respect to said rear wall part.

4. The tool holder as recited in claim 3, in which said limiting means comprises:

at least one slot in said rear wall part and at least one pin within said receiving means.

5. The tool holder as recited in claim 4, in which said slot defines an arc generally corresponding to a radius (R) of curvature, or distance, between an axis of said pivot means and said slot.

6. The tool holder as recited in claim 4, in which a pivot angle is established by said at least one pin, and guided into said slot by a length thereof to thereby comprise said means of limiting angular displacement between said rear wall part and said receiving means.

7. The tool holder as recited in claim 1, in which said receiving means at least partially bridges said transverse width of said peripheral lip of recessed offset means between said wall parts of said tool holder.

8. The tool holder as recited in claim 1, wherein said front wall part comprises two angled-off tabs, surfaces of which face forward a respectively other wall part.

9. The tool holder as recited in claim 1, further comprising:

a tool securing means integrally associated with said tool receiving means of said front wall part.

10. The tool holder as recited in claim 8, wherein said angled-off tabs of said front part, in a closed state of said tool holder, include a partial groove or a distance between them.

11. The tool holder as recited in claim 7, further comprising:

a hanging element having one end pivoted about an axis transverse to said recessed offset of said holder.

12. The tool holder as recited in claim 9, further comprising:

a hanging element comprising at least one latching element at an end region of said pivot means of said holder and facing toward said tool-securing means.

13. The tool holder as recited in claim 12, in which said latching element includes means for latching in a region of said tabs of said tool-securing means.

14. The tool holder as recited in claim 7, in which said tool holder includes lateral pins which latch into holes in the front wall part.

15. The tool holder as recited in claim 8, further comprising a hanging element including means for folding into a partial groove formed by said two angled-off tabs, and wherein said front wall part can be locked to said rear wall part.

16. The tool holder as recited in claim 1, in which said front wall part is releasably connected to said receiving means.

17. The tool holder as recited in claim 1, in which said rear wall part is releasably connected to said receiving means.

18. The tool holder as recited in claim 1, in which said receiving means of said tool holder includes a rigid strip comprising at least a part of said offset means.

19. The tool holder as recited in claim 1, in which at least one of said two wall parts includes a window or cutouts to view the interior thereof.

* * * * *